US007731286B2

(12) United States Patent
Wu

(10) Patent No.: US 7,731,286 B2
(45) Date of Patent: Jun. 8, 2010

(54) BACKREST ASSEMBLY

(76) Inventor: Yao-Chuan Wu, No. 1-1, Nei Pu Tsai, Ta Chi Tsun, Minhsiung Hsiang, Chiayi Hsien, 621 (TW)

( * ) Notice: Subject to any disclaimer, the term of this patent is extended or adjusted under 35 U.S.C. 154(b) by 0 days.

(21) Appl. No.: 12/202,383

(22) Filed: Sep. 1, 2008

(65) Prior Publication Data

US 2010/0052399 A1 Mar. 4, 2010

(51) Int. Cl.
*A47C 7/46* (2006.01)

(52) U.S. Cl. ..... 297/284.4; 297/301.7

(58) Field of Classification Search ..... 297/284.1, 297/284.4, 284.8, 285, 301.1, 301.7, 452.48, 297/452.49, 452.55, 452.56, 452.31, 303.1
See application file for complete search history.

(56) References Cited

U.S. PATENT DOCUMENTS 855,656 A * 6/1907 McNamara et al. ..... 297/284.4
3,642,319 A * 2/1972 Berchicci ..... 297/284.4
4,235,471 A * 11/1980 Tengler ..... 297/364
4,566,733 A * 1/1986 Compton ..... 297/284.1
4,810,033 A * 3/1989 Kemmann ..... 297/284.4
5,494,332 A * 2/1996 Daniel ..... 297/284.4
7,063,384 B2 * 6/2006 Liu ..... 297/284.4

* cited by examiner

*Primary Examiner*—Joseph F Edell
(74) *Attorney, Agent, or Firm*—Alan Kamrath; Kamrath & Associates PA

(57) ABSTRACT

A backrest assembly has a backrest board pivotally attached in front of a backrest frame and a buffering resilient device connected between the backrest board and the backrest frame. The buffering resilient device has two resilient brackets with through holes penetrated by a transversal adjusting rod and has a rotating tube sleeving the transversal adjusting rod to be operationally stopped by a stop bar protruded from the backrest frame. Therefore, the backrest board has a resilient and buffering efficiency relative to the backrest frame by setting the buffering resilient devices. By rotating the transversal adjusting rod to different positions, the brackets of the buffering resilient device is extended in length, and resilience of the backrest assembly is changed.

5 Claims, 6 Drawing Sheets

BACKREST ASSEMBLY

BACKGROUND OF THE INVENTION

1. Field of the Invention

The present invention relates to a backrest assembly and, more particularly, to a backrest assembly having a backrest board, a backrest frame and a buffering resilient device connected between the backrest board and backrest frame to provide extension and resiliency changes.

2. Description of Related Art

With reference to a conventional backrest structure with resilient and buffering efficiency, the backrest structure is constructed by boards filled with foams or a backrest frame covered with a net so that the backrest has a resilient and buffering efficiency by attaching resilient materials. Thereby, the backrest is more comfortable when users lean thereon.

However, The buffering design of the conventional backrest assembly achieves the buffering efficiency by providing partial deformation when the backrest is pressed by the most protruded portion on the user's back. When The user's back is supported by the backrest buffering design, the user's sitting posture is incorrect. Moreover, the conventional backrest cannot provide any efficiency to correct the user's posture or any fit variation of different users. Thus, users easily get tired with their incorrect postures after sitting for a long duration.

SUMMARY OF THE INVENTION

A main objective of the present invention is to provide a backrest assembly that has an adjustable and buffering resilient efficiency.

To achieve the foregoing objective, the backrest assembly, having a backrest board pivotally attached in front of a backrest frame at top ends, comprises:

a bottom end of the backrest board and a lower end of the backrest frame connected by a buffering resilient device, wherein the buffering resilient device has:

two brackets made of resilient material and secured between the backrest frame and the backrest board;

a transversal adjusting rod rotatably penetrating the brackets and having an obround-shaped shaft with two ends and a driving nub formed at one end of the obround-shaped shaft; and a rotating tube with an obround-shaped passage snugly sleeving the transversal adjusting rod between the two brackets so that the rotating tube is driven by the transversal adjusting rod.

Further benefits and advantages of the present invention will become apparent after a careful reading of the detailed description with appropriate reference to the accompanying drawings.

DETAILED DESCRIPTION OF THE PREFERRED EMBODIMENT

A backrest assembly in accordance with the present invention has a backrest board pivotally attached in front of a backrest frame and a buffering resilient device connected between the backrest board and the backrest frame. The buffering resilient device has two resilient brackets with through holes penetrated by a transversal adjusting rod and has a rotating tube sleeving the transversal adjusting rod to be operationally stopped by a stop bar protruded from the backrest frame. Therefore, the backrest board has a resilient and buffering efficiency relative to the backrest frame by setting the buffering resilient devices. By rotating the transversal adjusting rod to different positions, the brackets of the buffering resilient device is extended in lengths, and resilience of the backrest assembly is changed.

Figure 1:
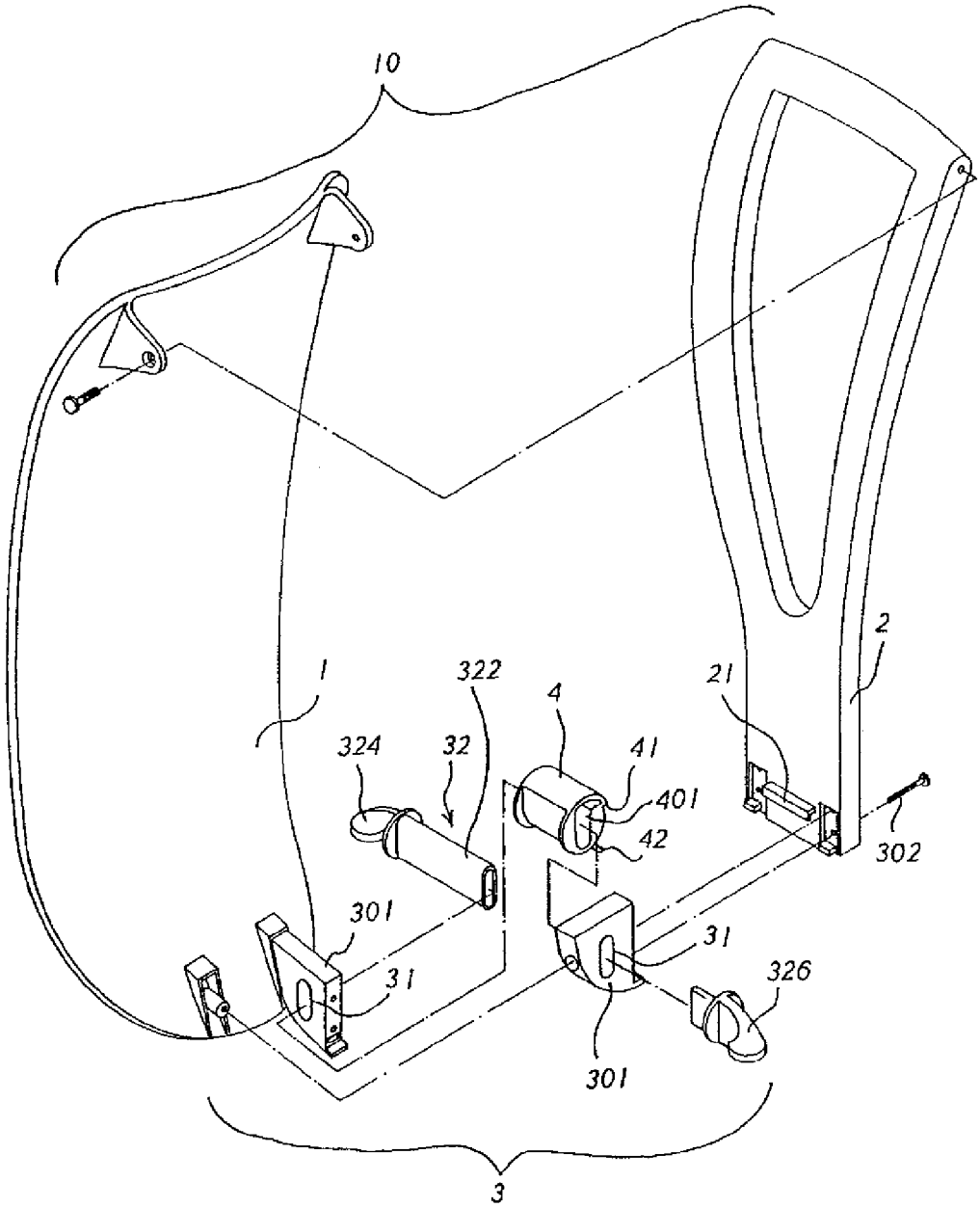
FIG. 1 is an exploded perspective view of a backrest assembly in accordance with the present invention.
Figure 2:
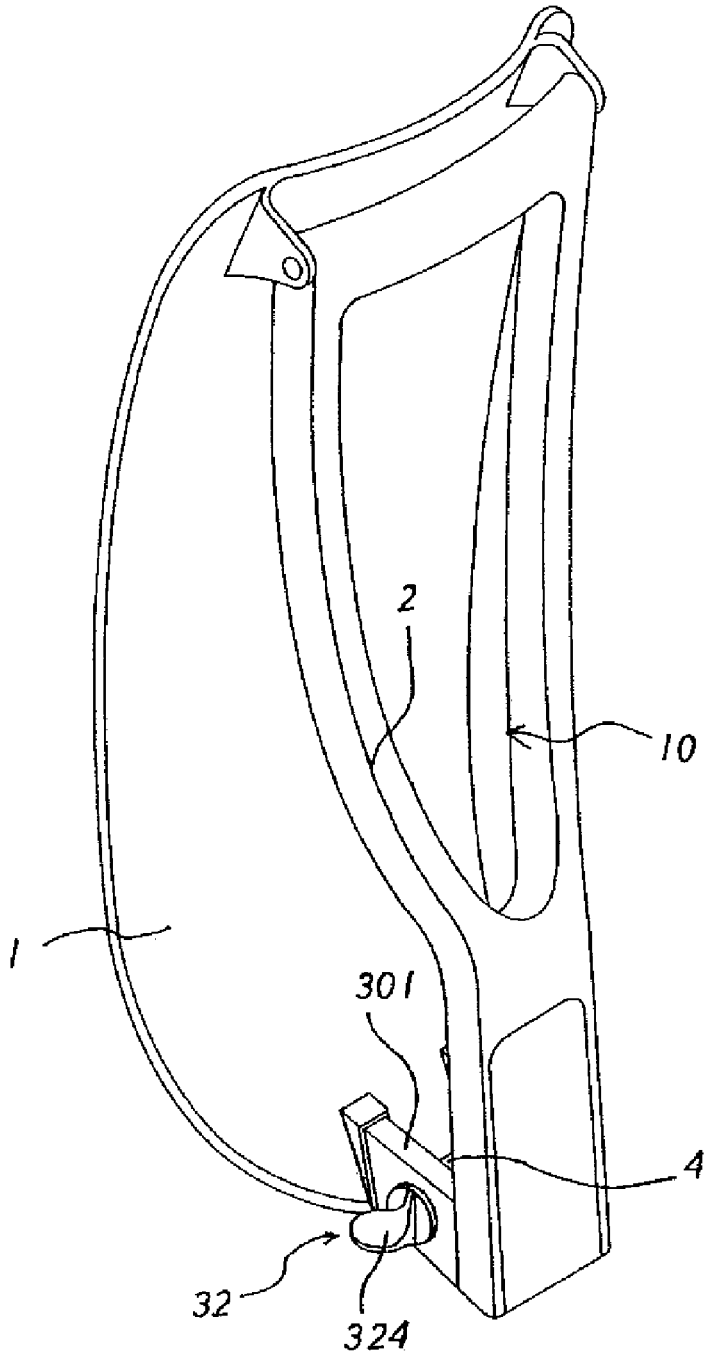
FIG. 2 is an assembled perspective view of the backrest assembly in FIG. 1.

With reference to FIGS. 1 and 2, a preferred embodiment of the backrest assembly 10 comprises a backrest board 1 pivotally attached in front of a backrest frame 2 at top ends for positioning. As shown in FIG. 1, the backrest frame 2 is adapted to combine with a seat, not shown. A bottom end of the backrest board 1 and a lower end of the backrest frame 2 are connected by a buffering resilient device 3. The buffering resilient device 3 has two brackets 301 secured between the backrest frame 2 and the backrest board 1, a transversal adjusting rod 32, and a rotating tube 4. The two brackets 301 are clamped between the backrest board 1 and the backrest frame 2 in parallel. Each bracket 301 has a through hole 31 aligned with the through hole 31 on the opposite bracket 301. The rotating tube 4 is rotatably clamped between the two brackets 301 and penetrated by the transversal adjusting rod 32 so that the rotating tube 4 is driven by the transversal adjusting rod 32.

Figure 3:
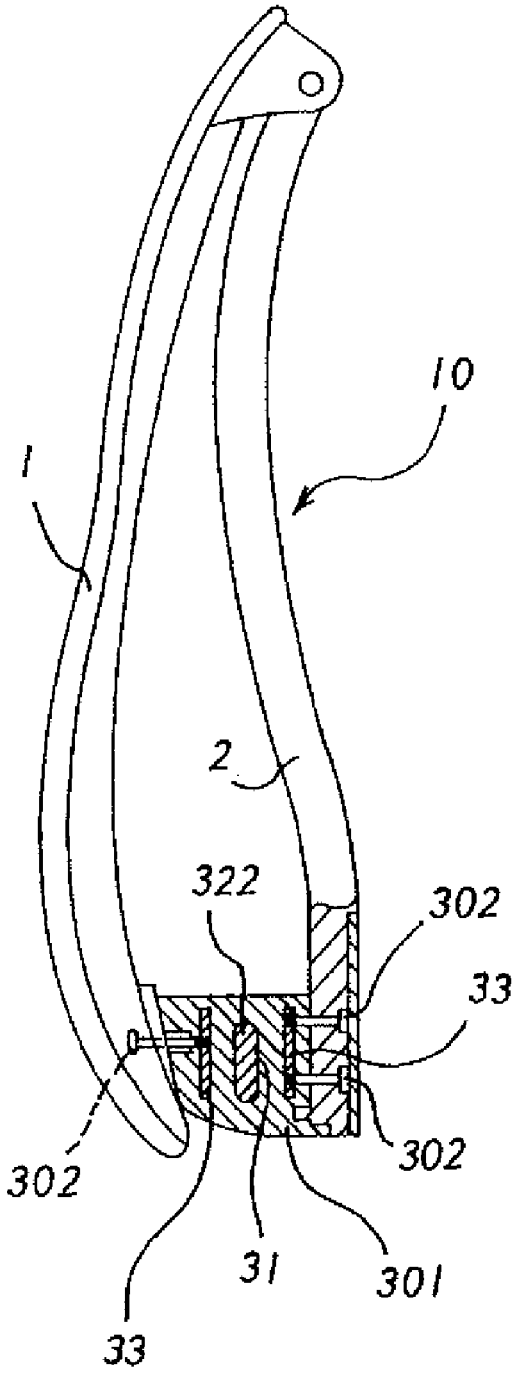
FIG. 3 is a cross-sectional side view of the backrest assembly showing a buffering resilient device clamped between a backrest board and a backrest frame.

As shown in FIGS. 1 and 3, each bracket 301 is made of resilient material and is secured to the backrest frame 2 and the backrest board 1 by multiple screws 302. The through hole 31 is obround-shaped to snugly combine with the transversal adjusting rod 32. To enhance the strength of the bracket 301, two metal fixing boards 33 are embedded respectively at two sides inside the bracket 301 to secure with the screws 302.

The transversal adjusting rod 32 penetrates the through holes 31 to rest on the brackets 301 and has a shaft 322 with an obround-shaped cross-section to engage with the rotating tube 4. A driving nub 324 is formed at one end of the transversal adjusting rod 32 to extend out of the bracket 301 to allow users to rotate the transversal adjusting rod 32 thereby. For assembly convenience, another end of the transversal adjusting rod 32 is detachably engaged with a wedge head 326.

Figure 4:
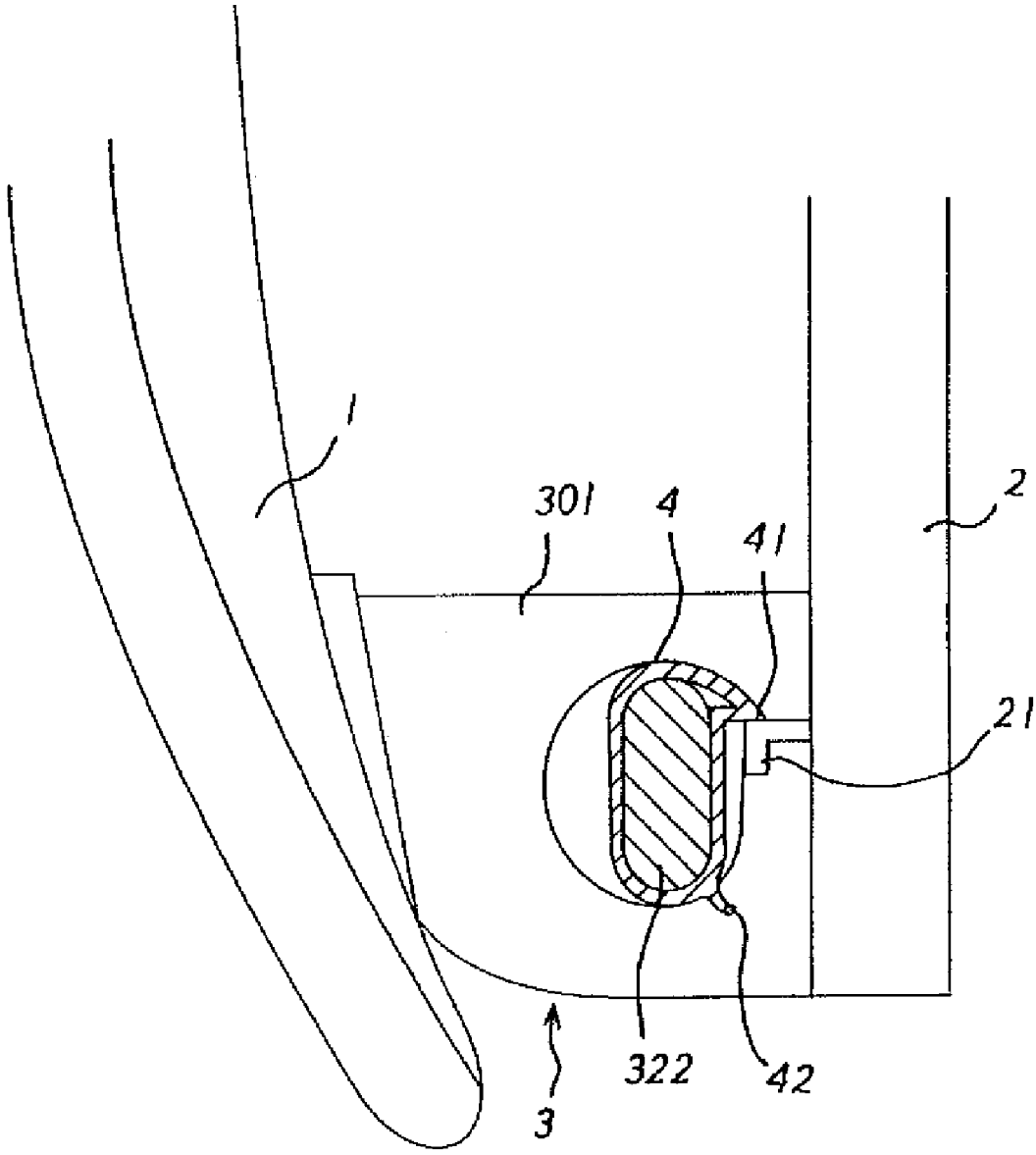
FIG. 4 is an enlarged cross-sectional side view of the buffering resilient device.

The rotating tube 4 clamping between the brackets 301 has a passage 401 longitudinally defined through the rotating tube 4 and has an outer periphery with a flange 41 and a protrusion 42 facing the backrest frame 2. The passage 401 with an obround shape snugly engages with the shaft 322 on the transversal rod 32. With reference to FIG. 4 in particular, the flange 41 is formed on a top portion of the rotating tube 4 and extends longitudinally on the outer periphery to operationally abut a stop bar 21 on the backrest frame 2. The protrusion 42 is formed on a bottom portion of the rotating tube 4 and extends longitudinally on the outer periphery to limit the stop bar 21 on the backrest frame 2 when the rotating tube 4 rotates as shown in FIG. 6.

According to the structure in the foregoing description, the backrest board 1 and the backrest frame 2 are pivotally combined by the buffering resilient device 3 to compose the backrest assembly 10. With reference to FIG. 3 again, the buffering resilient device 3 is made of resilient material, such as rubber particularly, to have resilience for buffering efficiency. Therefore, the backrest board 1 enables the brackets 301 of the buffering resilient device 3 to deform and enables the backrest board 1 to move toward the backrest frame 2 when the backrest board 1 is pushed. In other words, when the backrest board 1 supports against a user's leaning force, the deformation of the brackets 301 provides the buffering efficiency and inclination variation according to the leaning force so that backrest board 1 automatically adjusts its inclination to fit with the user's back and to correct the user's sitting posture to keep the user at a most comfortable situation.

Figure 5:
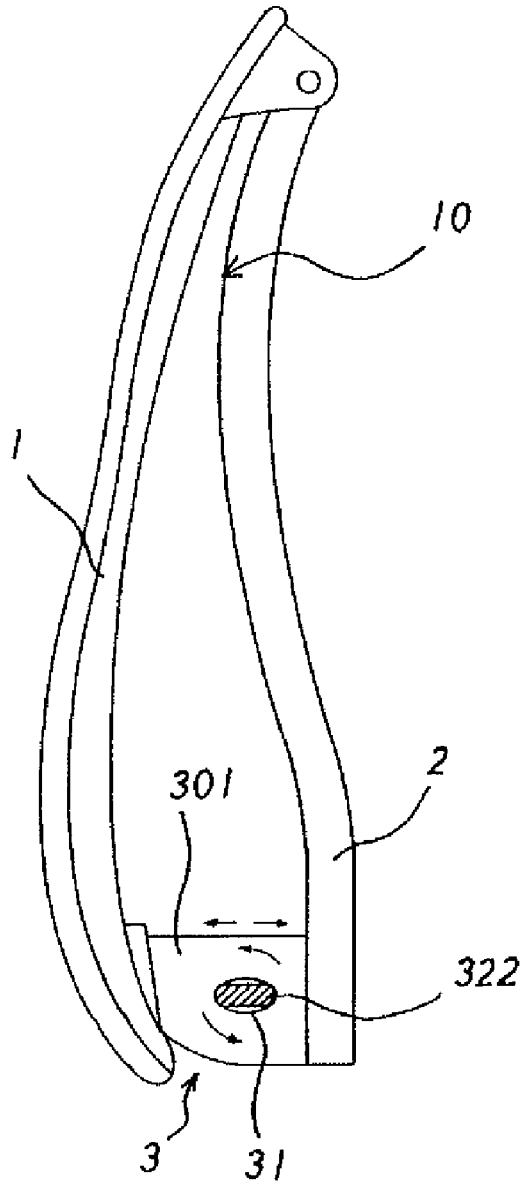
FIG. 5 is an operational cross-sectional side view of the buffering resilient device, wherein the backrest assembly is extended.
Figure 6:
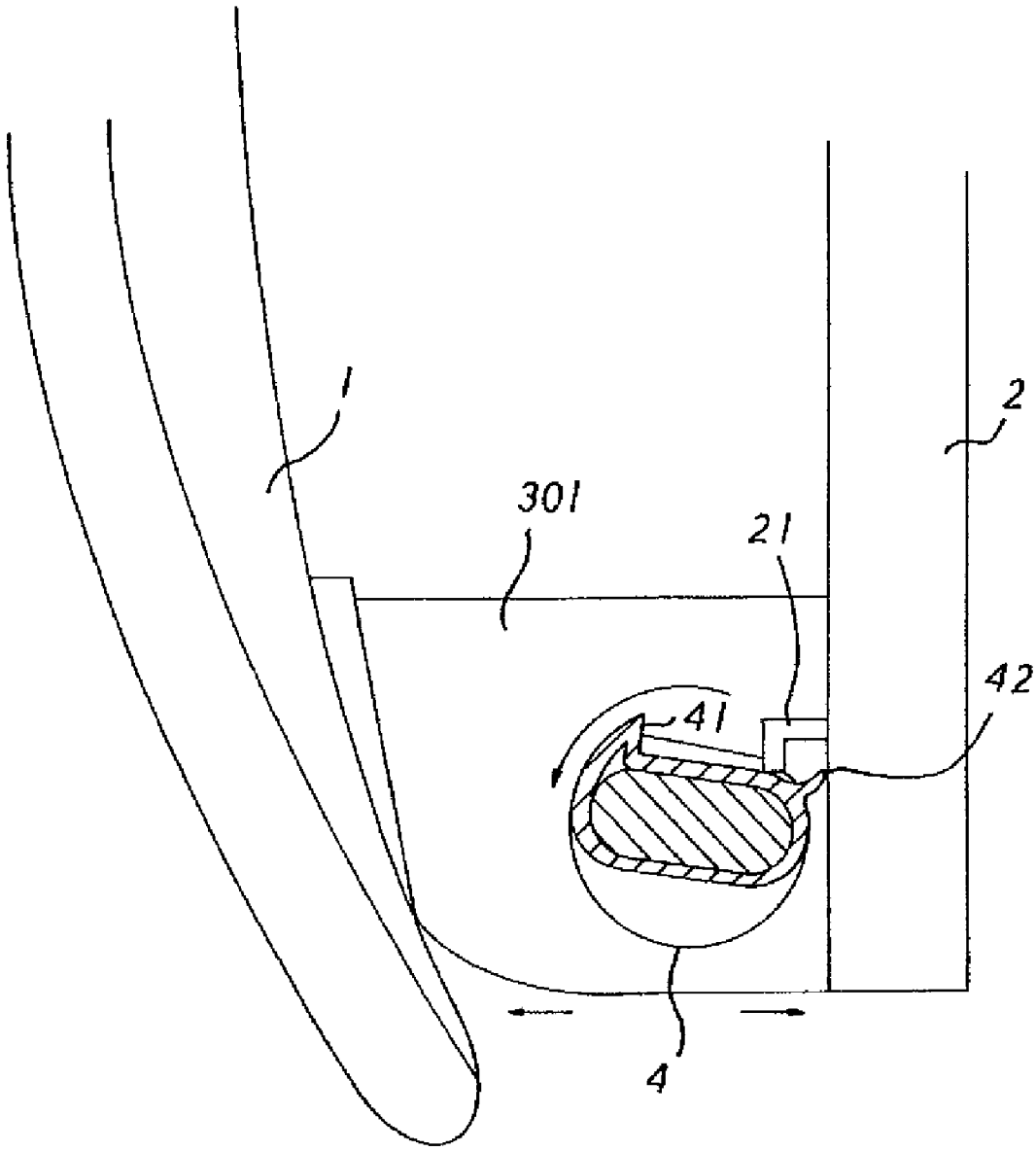
FIG. 6 is an enlarged operational cross-sectional side view of the buffering resilient device in accordance with FIG. 5.

When the transversal adjusting rod 32 is rotated counterclockwise (as shown in FIGS. 4, 5 and 6), the flange 41 on the rotating tube 4 separates from the stop bar 21 until the protrusion 42 abuts the stop bar 21. Meanwhile, the brackets 301 are extended, because the transversal adjusting rod 32 has its shaft 322 located at a transversal location so that its long diameter causes the brackets 301 to elongate. Because pressing by the transversal adjusting rod 32 diminishes the deforming variation of the brackets 301 (the rigidity of the brackets 301 are increased after extension), The buffering resilient device 3 provides different buffering forces after the bottom end of the backrest board 1 moves slightly forward driven by the extension of the brackets 301. Thereby, the backrest assembly provides different buffering efficiencies and accommodations corresponding to different postures and figures of different users.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A backrest assembly comprising:

a backrest board having a top end and a bottom end;

a backrest frame having a top end and a lower end; and a buffering resilient device, with the backrest board pivotally attached to the backrest frame at the top ends, with the bottom end of the backrest board and the lower end of the backrest frame connected by the buffering resilient device, wherein the buffering resilient device has:

two brackets made of resilient material and secured between the backrest frame and the backrest board;

a transversal adjusting rod rotatably penetrating the two brackets and having an obround-shaped shaft with first and second ends, and a driving nub formed at the first end of the obround-shaped shaft; and a rotating tube with an obround-shaped passage snugly sleeving the transversal adjusting rod between the two brackets, with the rotating tube driven by the transversal adjusting rod, with the two brackets being deformed by the obround-shaped shaft with rotation of the transversal adjusting rod to change resiliency of the two brackets.

2. The backrest assembly as claimed in claim 1, wherein each of the two brackets has a through hole of an obround shape to snugly combine with the transversal adjusting rod.

3. The backrest assembly as claimed in claim 1, wherein each of the two brackets has two metal fixing boards embedded respectively at two sides inside each of the two brackets to respectively secure with the backrest board and the backrest frame by screws.

4. The backrest assembly as claimed in claim 1, wherein the transversal adjusting rod detachably engages with a wedge head at the second end of the obround-shaped shaft.

5. The backrest assembly as claimed in claim 1, wherein the backrest frame has a stop bar formed on the lower end; and wherein the rotating tube further has an outer periphery with a flange and a protrusion facing the backrest frame to limit the stop bar between the flange and the protrusion when the rotating tube rotates.

* * * * *